US010645986B1

(12) United States Patent
Guzman

(10) Patent No.: US 10,645,986 B1
(45) Date of Patent: May 12, 2020

(54) COLLAPSIBLE MODULAR HAT

(71) Applicant: California Costume Collections, Inc., Los Angeles, CA (US)

(72) Inventor: Christopher Guzman, Los Angeles, CA (US)

(73) Assignee: CALIFORNIA COSTUME COLLECTIONS, INC, Los Angeles, CA (US)

( * ) Notice: Subject to any disclaimer, the term of this patent is extended or adjusted under 35 U.S.C. 154(b) by 0 days.

(21) Appl. No.: 16/105,899

(22) Filed: Aug. 20, 2018

Related U.S. Application Data

(60) Provisional application No. 62/548,537, filed on Aug. 22, 2017.

(51) Int. Cl.
*A42B 1/20* (2006.01)
*A42B 1/02* (2006.01)

(52) U.S. Cl.
CPC ..... *A42B 1/205* (2013.01); *A42B 1/02* (2013.01); *A42B 1/201* (2013.01); *A42B 1/206* (2013.01)

(58) Field of Classification Search
CPC ..... A42B 1/201; A42B 1/205; A42C 1/06
See application file for complete search history.

(56) References Cited

U.S. PATENT DOCUMENTS

| | | | | |
|---|---|---|---|---|
| 1,342,132 | A * | 6/1920 | Peters | A42B 1/205 2/195.5 |
| 2,105,002 | A * | 1/1938 | Miller | A42B 1/201 2/175.1 |
| 6,216,277 | B1 * | 4/2001 | Cheng | A42B 1/201 2/171.03 |
| 6,484,323 | B1 * | 11/2002 | Pu | A42B 1/201 2/10 |
| 2019/0297982 | A1 * | 10/2019 | Denny | A42B 1/02 |

* cited by examiner

*Primary Examiner* — Tajash D Patel
(74) *Attorney, Agent, or Firm* — Colin P. Abrahams

(57) ABSTRACT

A collapsible modular hat comprises a base having a base connector, a top having a top connector, and a side panel having an upper connector and a lower connector. The base connector of the base is releasably fastened to the lower connector on the side panel, and the top connector of the top is releasably fastened to the upper connector of the side panel.

19 Claims, 6 Drawing Sheets

COLLAPSIBLE MODULAR HAT

CROSS-REFERENCE TO RELATED APPLICATIONS

This application claims the benefit of United States Provisional PATENT Application Ser. No. 62/548,537, filed on Aug. 22, 2017, which is incorporated herein by reference in its entirety.

FIELD AND BACKGROUND OF THE INVENTION

This invention relates to a collapsible modular hat. More particularly, the invention relates to a hat having discrete components which can be joined together or separated from each other.

Hats and other forms of the headwear are well known clothing accessories which have been in existence for centuries in many different sizes and shapes. In many instances, such headwear often generally occupies a significant amount of space, and this impacts the costs and space requirements for their storage and transportation. Additionally, because of their significant size and configuration, any packaging needs to be proper and sufficient, failing which the headwear may sustain damage during handling, packaging, shipping and storage. Containers which do not have strong enough support structures may cause the hat to become damaged through crushing, folding, creasing or denting.

Furthermore, since hats and other headwear may be in whole or in part delicate and even fragile, and may have components which are somewhat irregular in shape, it is not always possible to stack similar or identical headwear one within the other as a result of irregular configuration.

SUMMARY OF THE INVENTION

According to one aspect of the invention, there is provided a collapsible modular hat comprising: a base having a base connector, a top having a top connector, and a side panel having an upper connector and a lower connector, wherein the base connector of the base is releasably fastened to the lower connector on the side panel, and the top connector of the top is releasably fastened to the upper connector of the side panel.

Preferably, the collapsible modular hat comprises a brim defining an aperture, and the base connector extends upwardly from around the brim near the aperture. The base connector may comprise fastening means located at multiple points. The fastening means may be selected from one or more of: snap fasteners, buttons, Velcro, hook and fastener.

In one embodiment, the top comprises a generally circular cover and a flange depending downwardly from the cover. The downwardly depending flange may comprise fastening means at multiple points, the fastening means being selected from one or more of: snap fasteners, buttons, Velcro, hook and fastener.

Preferably, the side panel comprises a generally rectangular piece having a first edge and a second edge, the first and second edges having fastening means thereon for configuring and fastening the generally rectangular piece into a generally cylindrical piece having an open upper end and an open lower end, the base connector of the base being connected to the open lower end, and the top connector of the top being connected to the open upper end. In one embodiment, the fastening means comprises a Velcro strips at the first edge and second edge respectively.

In one embodiment, the base connector of the base has four substantially equidistant Velcro loops; the top connector of the top has four substantially equidistant loops; the upper connector and the lower connector of the side panel each have four substantially equidistant Velcro hooks for attachment to the Velcro loops on the base connector and the top connector respectively.

In one aspect, the top and base are nestled with respect to each other, and the side panel is positioned adjacent thereto. An expandable bag may be provided for receiving the collapsible modular hat when in a collapsed condition, the expandable bag including a hanging hook. Further, a plurality of expandable bags containing each containing the collapsible modular hat in the collapsed condition may be stored within a box or container for storage and transportation purposes.

The collapsible modular hat may be shaped or ornamented to suit a specific occasion. Further, it may be comprised of a material selected from one or more of: leather, suede, felt, plastic, fabric, hide, or cardboard. Still further, the base, top, or side panel is adjustable in size and shape. Any one of the base, top or side panel may be mixed and matched with other base, top or side panel respectively.

In accordance with a further aspect of the invention, there is provided a collapsible modular hat comprising: a base having a base connector; and a top panel having a lower connector, wherein the base connector of the base is releasably fastened to the lower connector of the top panel.

According to yet a further aspect of the invention, there is provided a method of constructing a collapsible modular hat, the method comprising: providing a base having a base connector, providing a top having a top connector, and providing a side panel having an upper connector and a lower connector, releasably fastening the base connector of the base to the lower connector on the side panel, and releasably fastening the top connector of the top to the upper connector of the side panel.

The collapsible modular hat may be assembled and disassembled, resembling a hat when in the assembled condition, and compacted for storage and transportation when in the disassembled condition. Further, one or more of the base, top and side panel of the collapsible modular hat may be shaped and decorated to suit a preselected occasion.

According to one aspect of the invention, there is provided a collapsible modular hat comprising a base having a base connector, a top having a top connector, and a side panel having an upper connector and a lower connector, wherein the base connector of the base can be releasably fastened to the lower connector on the side panel, and the top connector of the top can be releasably fastened to the upper connector of the side panel. Preferably, the side panel comprises a generally cylindrical component wherein an elongate strip can be configured into the cylindrical component, and the elongate strip has at or near its edges means for selectively fastening the edges to each other to form a cylindrical component. The various components can be constructed and deconstructed many times, as the situation requires, so that the hat operates as a hat when constructed, and may be folded compactly when deconstructed for optimized storage and transportation.

The present invention is therefore directed towards a hat or headwear which is modular in construction, and comprises a plurality of modular sections which can be separated from each other for transportation and storage, but can easily be assembled when needed. Thus, the hat is in one sense collapsible when not needed, making it much easier to store the hat without causing damage, and not taking up an inordinate amount of storage space.

When in the deconstructed configuration, the headwear will, in one embodiment of the invention, preferably be relatively flat, especially when compared to one which is fully assembled, so that the components can be carefully packed to reduce the chance of damage, shipped in compact receptacles or containers which may be smaller and of more regular dimensions. As such, the deconstructed version of the modular hat of the invention is therefore less cumbersome and less expensive to ship.

In one form of the invention, the hat is comprised of three separate parts, components or modules, each of which can be readily connected to an adjacent module to construct the hat, and easily released for deconstruction and storage. Preferably, the collapsible hat of the invention has three sections or modules. The first such module may comprise a brim, the second a side wall of the hat, and the third a crown or top. In a preferred form of the invention, the side wall, which may typically be substantially cylindrical in shape, may have a cut or opening extending along its length from the top to the bottom thereof, so that this side wall itself can be rolled or folded or otherwise contacted so as to occupy less space when the hat is disassembled.

The collapsible and modular hat of the invention may be used in many different situations and contexts. While the hat may be of the conventional sort for everyday use, it may also comprise shapes and ornamentation which make it suitable for various holidays and occasions. As examples only, such occasions may include birthdays, graduations, anniversaries, national holidays such as the Fourth of July, plays, or for use with children. There are of course many other situations and occasions, too numerous to mention, and the invention is not limited in this regard.

With the growth of e commerce, and the increasing number of purchases which are made online and subsequently shipped, the collapsible hat of the invention offers many benefits. Handling and shipping, as well as the cost related thereto, are significant factors in e commerce, and the present invention facilitates much easier handling, smaller and more regular shaped shipping receptacles and containers, and less need for protective material such as bubble pack or Styrofoam chips or peanuts. All of these factors not only benefit the bottom line of the seller by reducing expenses, but also help to ensure that the consumer receives the product in a more pristine and undamaged condition. It is also very useful for more effectively returning products which may not fit or are no longer wanted.

The collapsible hat of the invention may be comprised of many materials. Felt is a popular material used in the manufacture of hats. However, the hats, or in fact different components of a hat, may be made of any other material including, but not limited to, plastic or other synthetic materials, cardboard, fabric, leather, silk, cotton, or hide, to name a few.

The headwear of the invention therefore comprises multiple pre molded and prefabricated modular sections. In one embodiment, there is at least one hat brim component, at least one side body piece component, and at least one crown component. Each of these components may be of different shape and configuration and still function so as to be assembled and disassembled from the other components. However, they may be hats constructed in accordance with the present invention which have only two components, as described more fully below. Further, there is no reason why the hat in accordance with the invention may have more than three components, if the nature of the hat dictates, and more components or sections are needed to properly construct a modular hat which has the desired shape and dimensions.

In use, the component parts are fastened together, with the hat brim to the body piece and the body piece to the crown piece. Fabric hooks, Velcro7 fastening, press studs or snap fasteners, zippers or other suitable mechanisms may be used to effect fastening of the components, and different types of fastening systems may be used between different components on the same hat. Once assembled, the prefabricated hat resembles a traditional solid piece hat, but has required less space and less supportive packaging than such a traditional solid piece hat. Since traditional hats have a large empty space inside them, and are prone to being damaged if stored or transported without protective packaging which is strong and sufficiently large, the prefabricated hat of the invention offers a more efficient product, especially for shipping and storage. By being deconstructed into separate pre molded parts, the hat is able to take up less space, further requiring less packaging which need not be as strong in order to keep it in shape.

DETAILED DESCRIPTION OF THE INVENTION

Reference is now made to the accompanying drawings which show various embodiments of the invention comprising the collapsible modular hat.

Figure 1A:
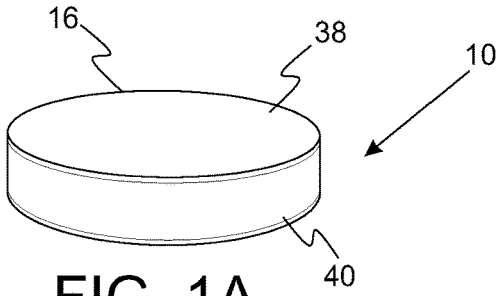
FIGS. 1A, 1B and 1C show a perspective exploded view of the separate components of a collapsible hat in accordance with the invention.
Figure 1B:
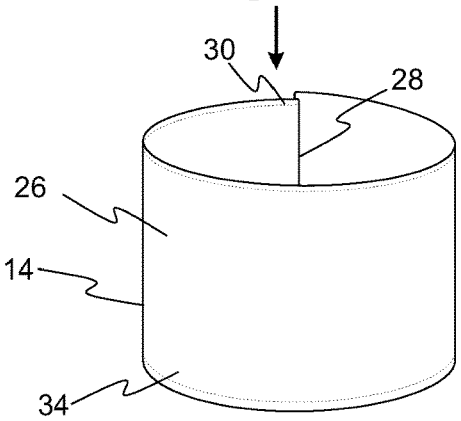
Figure 1C:
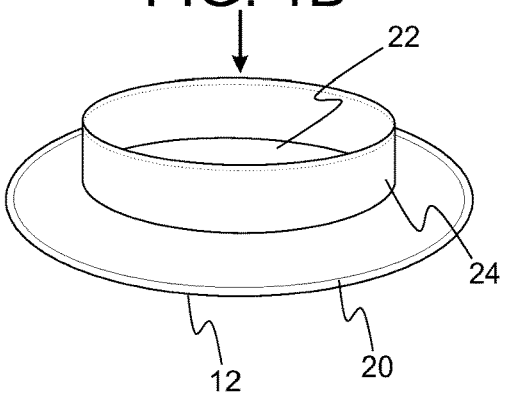

FIGS. 1A, 1B and 1C show a hat 10 comprised of a brim base 12, a side panel 14, and a top or crown 16. The brim base 12 comprises a brim ring 20 defining a generally circular open space 22, and a generally cylindrical collar or projection 24, wherein the brim ring 20 and cylindrical projection 24 are approximately coaxial. The side panel 14 comprises a generally flat elongate portion 26 having opposing ends 28 and 30. The opposing ends 28 and 30 can be releasably connected to each other so that the side panel 14 is flat, or so as to configure the flat elongate portion 26 into a cylindrical form. When so configured, the flat elongate portion 26 will be of about the same diameter as the cylindrical projection 24, and will releasably attach to it. Depending upon the style, the lower end 34 of the elongate portion 26 will either have a slightly larger diameter than the cylindrical projection 24 and fit over and around it, or it may have a slightly smaller diameter than the cylindrical projection 24, so as to be received within it.

The top or crown 16 comprises a top portion 38, and a downwardly depending flange 40. The downwardly depending flange 40 has a diameter which is substantially the same as that of the side panel 14 at its top end, and the flange 40 attaches to the side panel 14 at or near such top end. The flange 40 may be sized so as to have a slightly larger diameter than the top end of the side panel 14 so that the top end of the side panel 14 is received therewithin, or it may have a slightly smaller diameter than the top end of the side panel so that it is fittingly received within the top end of the side panel.

Figure 2:
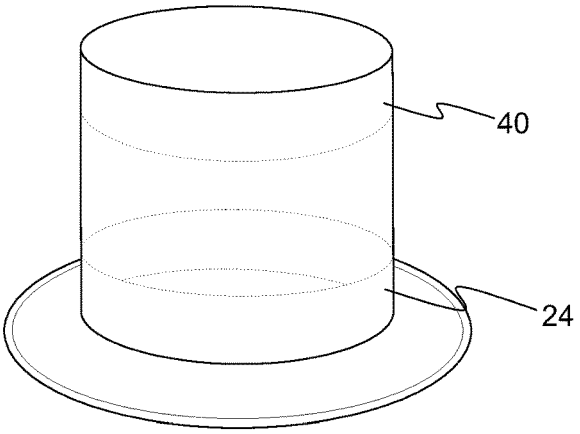
FIG. 2 shows a collapsible hat in accordance with the invention when assembled from the components illustrated in FIGS. 1A, 1B and 1C of the drawings.

FIG. 2 of the drawings shows a hat constructed and assembled using the three modular components and sections illustrated in FIGS. 1A, 1B and 1C. In the embodiment shown in FIG. 2, the cylindrical projection 24 and the flange 40 are both received within the side panel 26, although, as mentioned above, this construction may be reversed depending upon the style and preference of the user. This may be accomplished by, for example, the ability to adjust the circumference of the side panel 14, which will determine whether the cylindrical projection 24 and/or the flange 40 straddle the side panel or are contained within it.

Figure 3A:
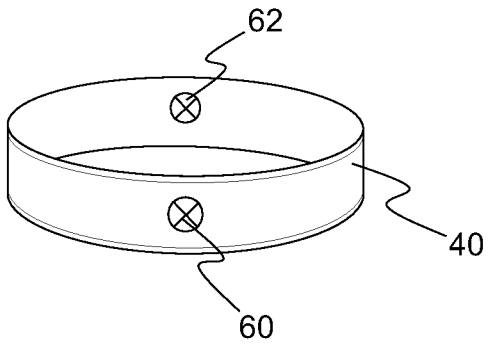
FIGS. 3A, 3B and 3C show a perspective exploded view of the separate components of a collapsible hat in accordance with the invention, illustrating in particular one mechanism for fastening these components together.
Figure 3B:
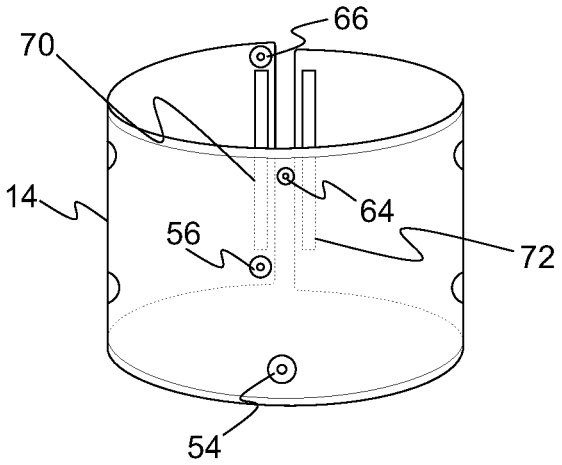
Figure 3C:
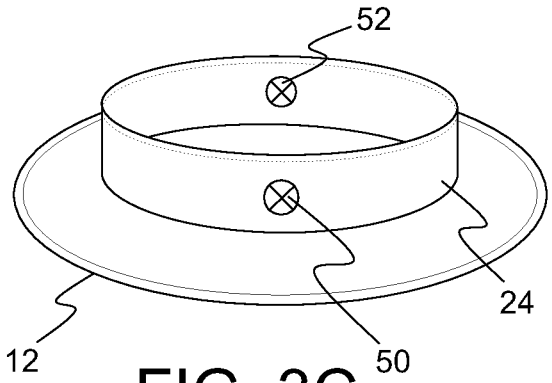

FIGS. 3A, 3B and 3C of the drawings are somewhat similar to those illustrated in FIGS. 1A, 1B and 1C, except that they show a specific embodiment for a fastening mechanism to hold the components together. In these figures, the same reference numerals are used to identify like components illustrated in the previous figures.

In these FIGS. 3A, 3B and 3C, hook and loop structures, known commonly under the trademark Velcro, are used to releasably secure components to each other. Thus, the brim base 12 may, in one embodiment, have a patch of Velcro loops 50 and 52 on opposed or spaced outer surfaces of the cylindrical projection 24. Note that these may be preferred locations, and that any suitable number and size of Velcro loops (or hooks) can be placed in selected positions on the cylindrical projection 24. The side panel 14 has lower Velcro hooks 54 and 56 which will register with at least some of, but all of in the present embodiment, the loops 50 and 52 when the side panel 14 is mounted over the brim base 12 so that the two remain fixed to each other until such time as sufficient force to separate the hooks from the loops is applied.

In one preferred embodiment, only the center back of the hat stand has a Velcro hook and loop to fasten and secure it closed. The sideband and crown have Velcro hooks only which allows them to fasten and adhere reasonably securely to the nap or texture of the felt. In this version, the molded brim is free of any hook or loop.

In similar fashion, the top or crown 16 has on the outer surface of the flange 40 a pair of diametrically opposed Velcro loops 60 and 62. The side panel 14 has a pair of upper Velcro hooks 64 and 66, on the inner surface, appropriately positioned so that some or all engage with the loops 60 and 62 on the flange 40. Once more, differently located and sized hooks and loops may be used, in different numbers.

The side panel 14 itself has a strip of Velcro loops 70 and a strip of Velcro hooks 72 (or vice versa) on opposing end edges so that when these overlap the side panel can be fixed into its cylindrical shape. When not in use, he hat can be disassembled, and the Velcro loop and hook 70 and 70 to disengaged or pulled apart from each other so as to fold the side panel 14 into a shape which facilitates easier handling, shipping and storing.

Figure 4:
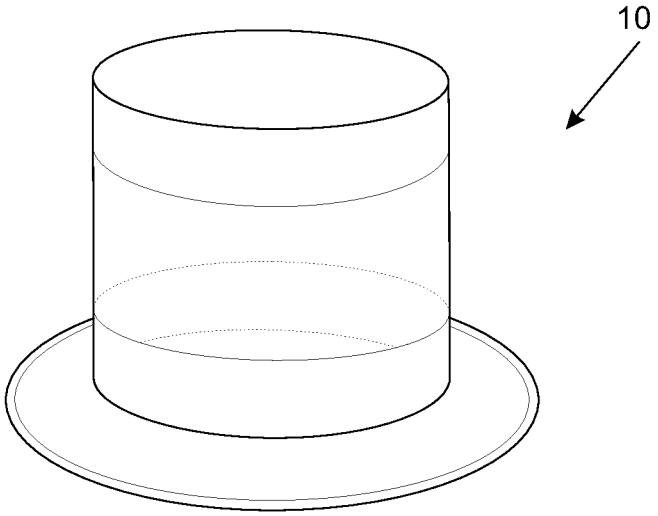
FIG. 4 shows a collapsible hat in accordance with the invention assembled from the components in FIGS. 3A, 3B and 3C of the drawings.

A hat duly assembled with the components illustrated in FIGS. 3A, 3B and 3C is illustrated in FIG. 4 of the drawings.

It should be noted that the various components which constitute the hat modules can vary in shape, size and material. For example, the side panel 14 may have more height or less height, or, indeed, different heights along its length. The base brim 10 may have a brim ring 20 of many different shapes and widths, which may depend upon the length and shape of the side panel 14. Further, its width may vary in one particular embodiment. The brim ring 20 may be curved, contoured, peaked or have any other desirable shape. The crown 16, too, may be flat, convex, dented or be or any other shape. Furthermore, the cylindrical projection 24 and the flange 40 need not be completely circular entities, but may be crenellated, rounded or such other shape provided they fulfill the function of providing a mechanism for suitable connection to the side panel 14.

Figure 5:
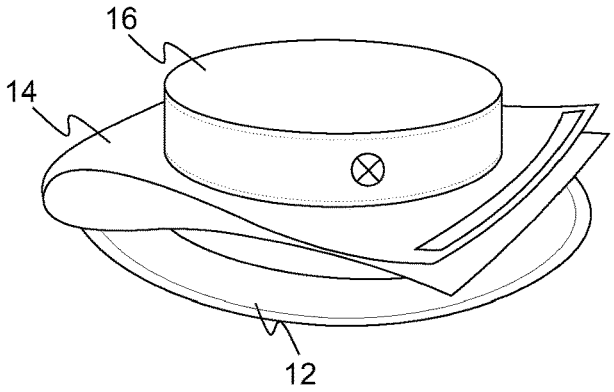
FIG. 5 shows a perspective view of the various components of the hat in accordance with the invention in a folded condition suitable for storage or transportation.

FIG. 5 of the drawings shows a hat in its collapsed configuration, with the brim base 12 at the bottom, the crown 16 on top, and the side panel 14 sandwiched between the two. It will be clearly seen that the space occupied by the collapsed hat is substantially less than that of the constructed hat. In some embodiments, the flange 40 and the brim ring 24 may be dimensioned so that the one fits in the other, allowing an even more compact packaging arrangement.

Figure 6:
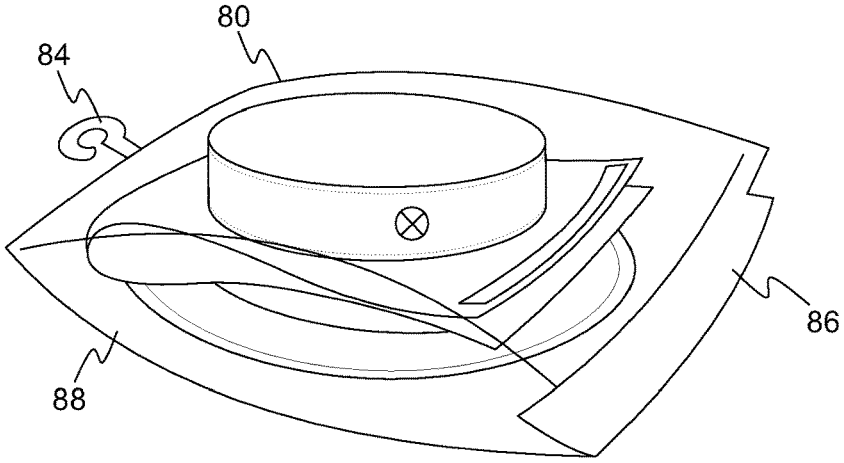
FIG. 6 shows a perspective view of the various components of the hats in accordance with the invention contained within a bag.

FIG. 6 of the drawings shows the collapsed components of the hat, as illustrated in FIG. 5 of the drawings, stored within an expandable bag 80. The bag 80 has a top end 82 with a convenient built in hanging hook 84, and an expandable bottom end 86. The sides 88, or at least one of the sides 88, may be open, with possible closure mechanisms, so that the bag 80 can be expanded and the hat components placed therein. In other embodiments, the sides may be at least partially closeable so that, once the hat components have been inserted within the expandable bag 80, they will not be able to fall out.

Figure 7:
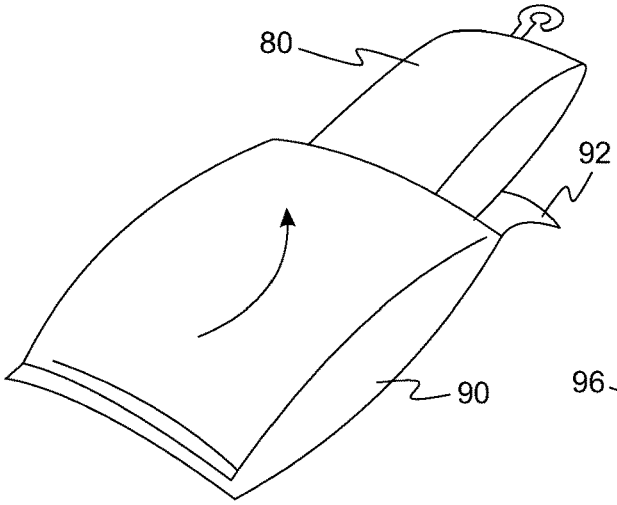
FIG. 7 shows a perspective view of a further embodiment of an outer receptacle container for receiving and accommodating a bag such as the one illustrated in FIG. 6 of the drawings.

FIG. 7 of the drawings shows the expandable bag 80 which is receivable within a packing bag 90. Such a packing bag 90 may be useful for storing a single or only a small number of collapsed hat components or sets. The packing bag 90 includes an open top end and a flap 92 for closing the packing bag 90.

Figure 8:
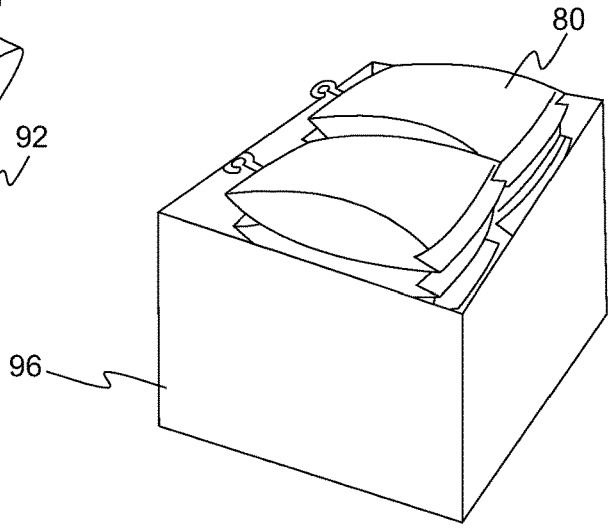
FIG. 8 shows a plurality of, or multiple, container bags, such as of the type illustrated in FIG. 6 of the drawings, stored within a box for shipping or transporting a plurality of hats which have been collapsed and stored in the box, in accordance with the present invention.

In FIG. 8 of the drawings, a different type of packaging arrangement is illustrated, whereby a more significant number of collapsed hats contained within an expandable bag 80 are stacked within a box, suitable for storage or transportation of multiple products of the invention.

Figure 9:
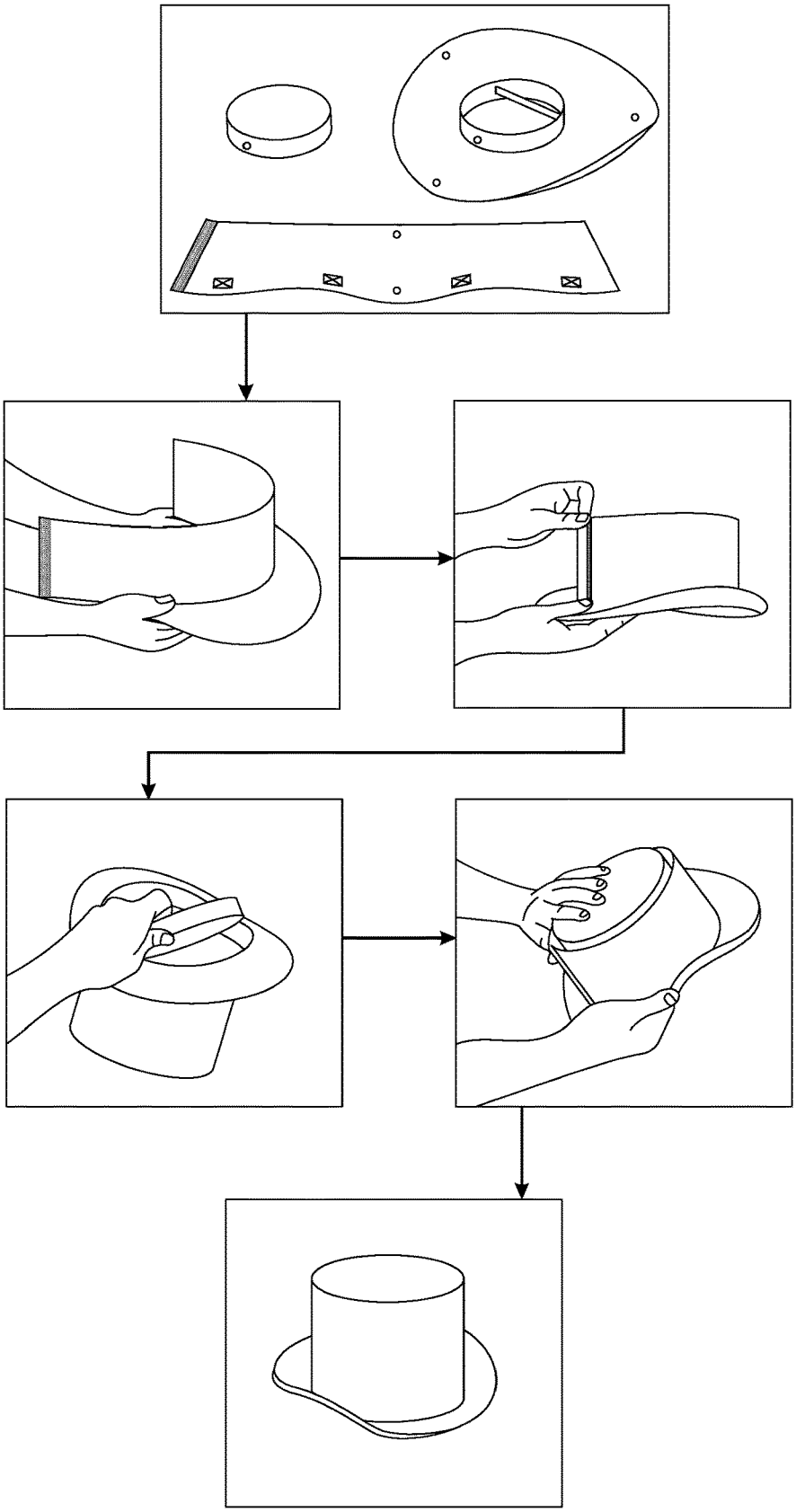
FIG. 9 of the drawings illustrates and describes sequential steps for constructing a top hat having three components, in accordance with the invention.

Reference is now made to FIG. 9 of the drawings. This figure describes and illustrates six steps for assembling a top hat, one type of hat of many which may be utilized in accordance with the invention. As will be seen, the top hat comes in three pieces for assembly, namely, the molded crown top, the molded brim, which may include an elastic band to provide a better fit, and a sideband with a substantially straight top and a curved bottom. In the first step, red colored dots or other identifiers or markers are aligned on the brim and the sideband so that these two parts can be registered and matched to each other and joined. In step two, the sideband is closed, so that it becomes cylindrical in shape from a previously flat shape. In the third step, the crown is added by turning the hat upside down, preferably on a flat surface, and differently colored dots or other identifiers or markers aligned when the crown is fully inserted. The crown is then gently tapped down until it is flush with the flat surface. In the fourth step, the hat is turned over and checked so that all alignment markers are matched, and the crown top can be adjusted relative to the sideband. In the fifth step, Velcro connections between the parts are firmly pressed to complete the assembly, resulting in a hat with a seamless, or near a seamless, appearance.

Figure 10:
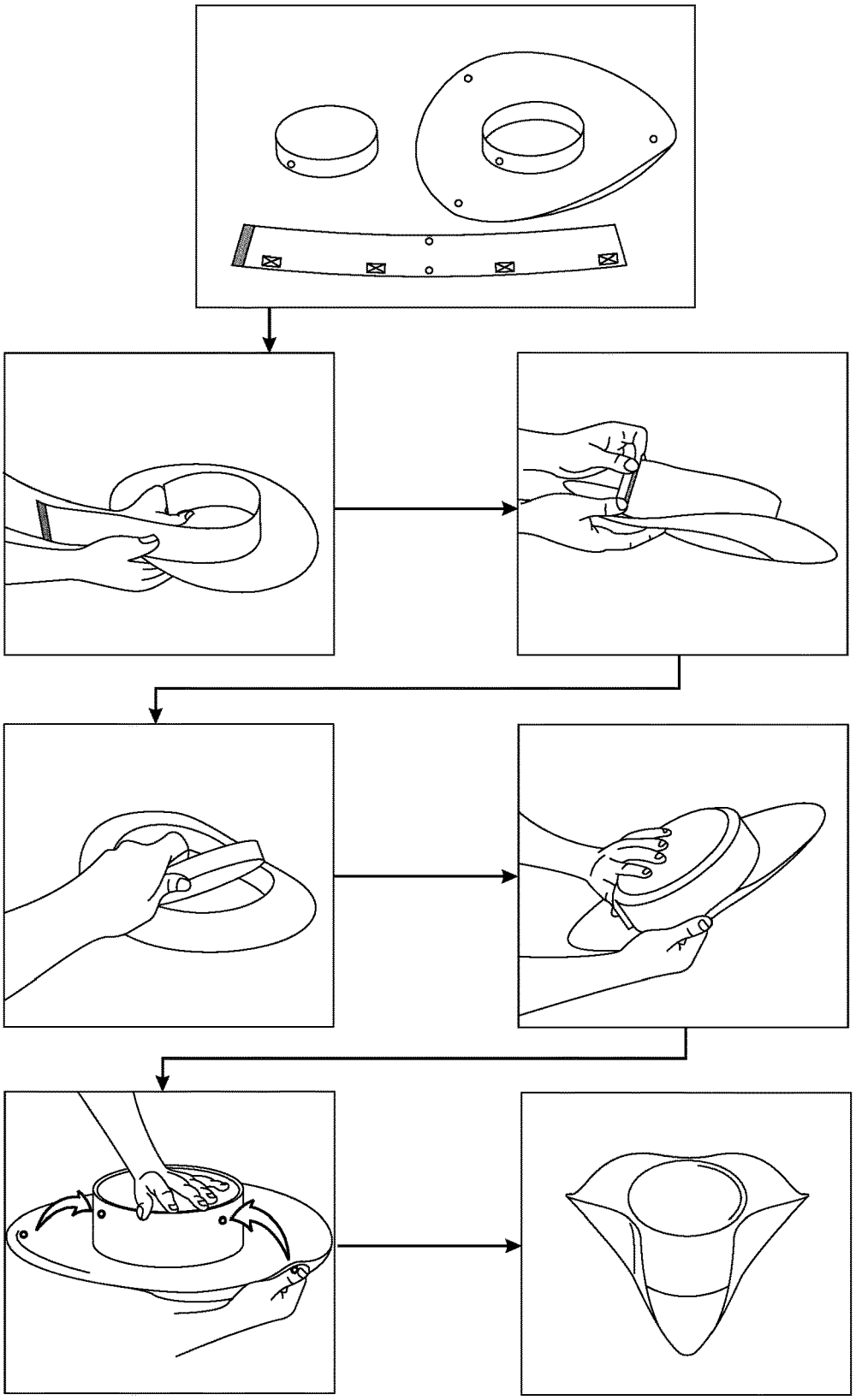
FIG. 10 of the drawings illustrates and describes sequential steps for constructing a pirate hat having three components, in accordance with the invention.

FIG. 10 of the drawings describes and illustrates instructions for a pirate hat assembly. This hat comprises the molded crown top, the molded brim, and a sideband, notably of a little less height than that in the previous figure. In steps one, two, three and four, the various parts of the hat are assembled in much the same way as was described above with respect to the top hat illustrated in FIG. 9. In the fourth step, the Velcro connectors are firmly pressed to join the various components, and, further, connected between the brim and the side panel, as illustrated by the pair of arrows seen in step five, are joined. Step six of the drawings shows the fully assembled hat, seamless or near seamless, in a pirate form, ready for use.

Figure 11:
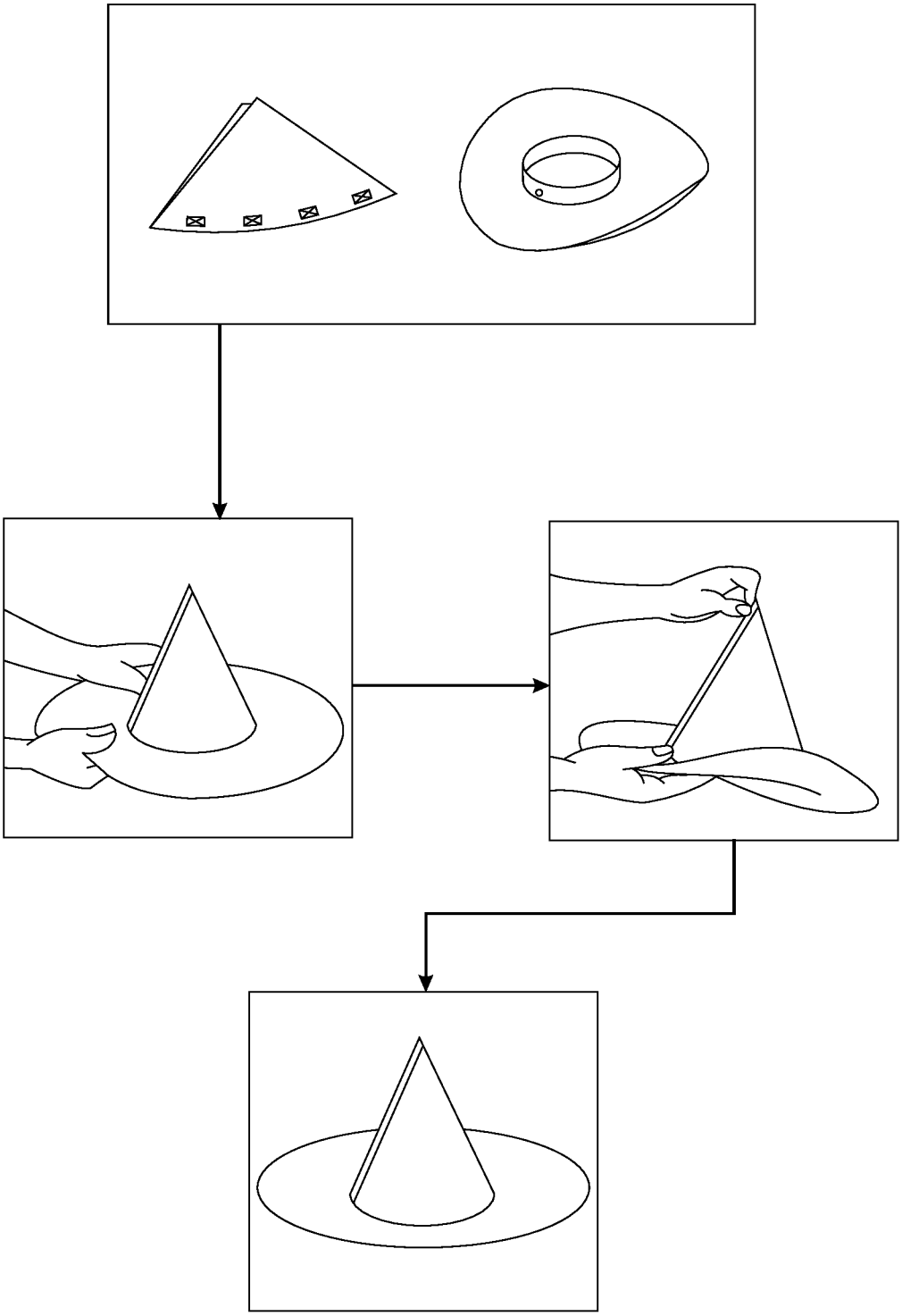
FIG. 11 of the drawings illustrates and describes sequential steps for constructing a witch hat comprised of two components, in accordance with the invention.

FIG. 11 of the drawings describes and illustrates instructions for the assembly of a witch hat. In this particular embodiment, there are two components, namely, a cone having a curved bottom and a pointed top, and a molded brim. Step one shows the attachment of the cone to the brim by curving it around a portion of the pre-molded brim, with the Velcro hook facing inward. The cone is snugly matched, and the Velcro back is attached. Finally, in step three, the assembled hat is illustrated, after all Velcro parts have been firmly pushed together so that the hat presents a seamless, or near seamless, appearance.

It will be seen that FIGS. 9, 10 and 11 show three different versions or embodiments of a collapsible hat assembly in accordance with the invention. However, it should be appreciated that these are exemplary only, and the number of different types of hats and styles can be made in accordance with the invention, which is thus not limited to these three examples.

It will be appreciated that the drawings show a few embodiments and options of the invention, but that many variations are possible. Some have been described above. Others may include surface ornamentation, decorations or design art on any of the components, in whole or in part. Any form of attachment between the components would also fall within the scope of the invention. This may include press studs or snap fasteners, buttons, zippers, tape, glue and the like. Additionally, the components may be configured so that, upon assembling them, they fit tightly enough so that they will not readily come apart under normal use. In this case, the tight fit constitutes the connectors and the form of connection.

The collapsible and modular hat of the invention may also benefit from mix and match opportunities. For example, a top and brim may be used with differently styled, colored or shaped side pieces. A user may also be able to buy different types of modules individually, or a set of modules so that the hat can be used on different occasions based on a relevant designed module selected.

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open ended, i.e., to mean including but not limited to. Only the transitional phrases "consisting of" and "consisting essentially of", respectively, are closed or semi closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

The invention claimed is:

1. A collapsible modular hat comprising:

a base having a base connector, a top having a top connector, and a side panel having an upper connector and a lower connector, wherein the base connector of the base is releasably fastened to the lower connector on the side panel, and the top connector of the top is releasably fastened to the upper connector of the side panel.

2. A collapsible modular hat as claimed in claim 1 wherein the base comprises a brim defining an aperture, and the base connector extends upwardly from around the brim near the aperture.

3. A collapsible modular hat as claimed in claim 1 wherein the base connector comprises fastening means located at multiple points.

4. A collapsible modular hat as claimed in claim 1 wherein the fastening means are selected from one or more of: snap fasteners, buttons, Velcro, hook and fastener.

5. A collapsible modular hat as claimed in claim 1 wherein the top comprises a generally circular cover and a flange depending downwardly from the cover.

6. A collapsible modular hat as claimed in claim 5 wherein the downwardly depending flange comprises fastening means at multiple points, the fastening means being selected from one or more of: snap fasteners, buttons, Velcro, hook and fastener.

7. A collapsible modular hat as claimed in claim 1 wherein the side panel comprises a generally rectangular piece having a first edge and a second edge, the first and second edges having fastening means thereon for configuring and fastening the generally rectangular piece into a generally cylindrical piece having an open upper end and an open lower end, the base connector of the base being connected to the open lower end, and the top connector of the top being connected to the open upper end.

8. A collapsible modular hat as claimed in claim 7 wherein the fastening means comprises a Velcro strips at the first edge and second edge respectively.

9. A collapsible modular hat as claimed in claim 1 wherein the base connector of the base has four substantially equidistant Velcro loops; the top connector of the top has four substantially equidistant loops; the upper connector and the lower connector of the side panel each have four substantially equidistant Velcro hooks for attachment to the Velcro loops on the base connector and the top connector respectively.

10. A collapsible modular hat as claimed in claim 1 which has a collapsible position wherein the top and base are nestled with respect to each other, and the side panel is positioned adjacent thereto.

11. A collapsible modular hat as claimed in claim 1 further comprising an expandable bag for receiving the collapsible modular hat when in a collapsed condition, the expandable bag including a hanging hook.

12. A collapsible modular hat as claimed in claim 11 wherein a plurality of expandable bags containing each containing the collapsible modular hat in the collapsed condition are stored within a box for storage and transportation purposes.

13. A collapsible modular hat as claimed in claim 1 shaped or ornamented to suit a specific occasion.

14. A collapsible modular hat as claimed in claim 1 comprised of a material selected from one or more of: leather, suede, felt, plastic, fabric, hide, or cardboard.

15. A collapsible modular hat as claimed in claim 1 wherein the base, top, or side panel is adjustable in size and shape.

16. A collapsible modular hat as claimed in claim 1 wherein any one of the base, top or side panel can be mixed and matched with other base, top or side panel respectively.

17. A method of constructing a collapsible modular hat, the method comprising:

providing a base having a base connector, providing a top having a top connector, and providing a side panel having an upper connector and a lower connector, releasably fastening the base connector of the base to the lower connector on the side panel, and releasably fastening the top connector of the top to the upper connector of the side panel.

18. A method as claimed in claim 17 wherein the collapsible modular hat is assembled and disassembled, resembling a hat when in the assembled condition, and compacted for storage and transportation when in the disassembled condition.

19. A method as claimed in claim 17 wherein one or more of the base, top and side panel of the collapsible modular hat is shaped and decorated to suit a preselected occasion.

* * * * *